US012220611B2

(12) United States Patent
Hsu

(10) Patent No.: US 12,220,611 B2
(45) Date of Patent: Feb. 11, 2025

(54) MULTIFUNCTIONAL RECUMBENT EXERCISING DEVICE

(71) Applicant: Chih-Yung Hsu, Tainan (TW)

(72) Inventor: Chih-Yung Hsu, Tainan (TW)

( * ) Notice: Subject to any disclaimer, the term of this patent is extended or adjusted under 35 U.S.C. 154(b) by 231 days.

(21) Appl. No.: 17/989,136

(22) Filed: Nov. 17, 2022

(65) Prior Publication Data

US 2024/0082625 A1 Mar. 14, 2024

(30) Foreign Application Priority Data

Sep. 13, 2022 (TW) ..... 111134508

(51) Int. Cl.

| | |
|---|---|
| ***A63B 21/00*** | (2006.01) |
| ***A63B 21/04*** | (2006.01) |
| ***A63B 21/22*** | (2006.01) |
| ***A63B 23/035*** | (2006.01) |

(52) U.S. Cl.

CPC .... *A63B 21/4029* (2015.10); *A63B 21/00058* (2013.01); *A63B 21/0442* (2013.01); *A63B 21/154* (2013.01); *A63B 21/156* (2013.01); *A63B 21/4035* (2015.10); *A63B 21/4043* (2015.10); *A63B 23/03566* (2013.01); *A63B 21/225* (2013.01); *A63B 2208/0252* (2013.01); *A63B 2225/09* (2013.01); *A63B 2225/102* (2013.01)

(58) Field of Classification Search

CPC ..... A63B 21/00058; A63B 21/0442; A63B 21/154; A63B 21/156; A63B 21/225; A63B 21/4029; A63B 21/4035; A63B 21/4043; A63B 21/00047; A63B 23/03566; A63B 2208/0252; A63B 2225/09; A63B 2225/102

See application file for complete search history.

(56) References Cited

U.S. PATENT DOCUMENTS

| | | | | |
|---|---|---|---|---|
| 7,740,563 | B2 * | 6/2010 | Dalebout | A63B 22/0664 482/52 |
| 2012/0100965 | A1 * | 4/2012 | Dreissigacker | A63B 22/0005 482/72 |
| 2023/0372762 | A1 * | 11/2023 | Mitchell | A63B 21/154 |
| 2023/0381573 | A1 * | 11/2023 | Hsu | A63B 21/4031 |
| 2024/0181291 | A1 * | 6/2024 | Hsu | A63B 21/154 |

FOREIGN PATENT DOCUMENTS

| | | | |
|---|---|---|---|
| DE | 29608553 | U1 | 11/1996 |
| DE | 202018103091 | U1 | 7/2018 |
| DE | 202022106160 | U1 | 11/2022 |
| TW | I433700 | B | 4/2014 |
| TW | M624483 | U | 3/2022 |

* cited by examiner

*Primary Examiner* — Megan Anderson

(74) *Attorney, Agent, or Firm* — Muncy, Geissler, Olds & Lowe, P.C.

(57) ABSTRACT

A multifunctional recumbent exercising device is disclosed, including a base frame, a first transmission unit, a first retracting unit, a resistance unit, a first guiding piece and a first movable seat. By changing a relative position between the first movable seat and the first guiding piece, the position of a first slide-assistance portion of the first movable seat on the base frame can be changed. The multifunctional recumbent exercising device allows an operator to apply force to a first side or a second side of the base frame, in order to select various kinds of training modes.

24 Claims, 16 Drawing Sheets

MULTIFUNCTIONAL RECUMBENT EXERCISING DEVICE

BACKGROUND OF THE INVENTION

(a) Field of the Invention

The present invention relates to an exercising device which can be used selectively in various kinds of training modes by changing a relative position between a movable seat and a guiding piece.

(b) Description of the Prior Art

There are many kinds of exercising apparatuses on the market, and each one has its various training modes for users' choice.

For example, a Taiwanese invention patent 1433700, "Stretching Equipment," published on Apr. 11, 2014, discloses a patent including a bed, a supporting device, a stretching device and a shifting apparatus. The supporting device is used for supporting the bed. The stretching device has a footboard and a linking-up portion. The shifting apparatus has a movable element and a regulation element. The movable element is disposed on the linking-up portion. The regulation element can make the movable element shifted between a first position and a second position, and then located at any point. The movable element can have the linking-up portion shifted, and the linking-up portion can have the footboard shifted between a third position and a fourth position, and then located at any point. Therefore, a user can lie on the bed and adjust his or her foot's setting angle directly, without moving his or her body at all.

This prior art is only provided with a single training mode for extending or stretching legs and cannot be used to train other parts of the body. Therefore, if one needs to carry out the training in various training modes, he or she will have to purchase other corresponding exercising apparatuses, which causes waste and takes up too much space to emplace the apparatuses.

Accordingly, a Taiwanese utility model patent M624483, "Multifunctional Rowing Machine," published on Mar. 11, 2022, discloses a machine including a rack unit, a resistance unit, and a drive unit. The rack unit includes a main rack, a first bracket connected to the main rack, at least one second bracket connected to the first bracket, and an auxiliary bracket connected to the main rack. The rack unit can change between a horizontal state and an upright state. In the horizontal state, a main connecting rod is placed horizontally, and the first bracket and the auxiliary bracket are supported on ground. In the upright state, the main connecting rod is vertically placed, and the second bracket and the first bracket are supported on the ground. The resistance unit is disposed on the rack unit and is used to provide resistance. The drive unit is disposed on the rack unit and is connected to the resistance unit. By the rack unit, the effect of having a variety of exercising types to enhance the effect of muscle training and save space can be achieved.

The rack unit of the prior art can change between the horizontal state and the upright state to achieve the training modes for various kinds of exercises. However, in changing between the horizontal state and the upright state, the structure of the rack unit needs to be changed to be placed horizontally or vertically, which is rather troublesome in implementation. In addition, it wastes a lot of time in dismantling and assembling the rack unit; therefore, it is not very perfect in using the rowing machine.

SUMMARY OF THE INVENTION

Accordingly, in terms of the abovementioned shortcomings in the existing recumbent exercising devices, the present invention provides a multifunctional recumbent exercising device comprising a base frame which is extended in a horizontal direction and includes a recumbent portion; a first transmission unit which is disposed on the base frame and includes a first pull cord, with the first pull cord including a first free end and first fixed end; a first retracting unit which is disposed on the base frame and is connected to the first transmission unit; a resistance unit which is disposed on the base frame; a first guiding piece which is disposed on the base frame; and a first movable seat which selectively moves on or is fixed on the first guiding piece, with the first fixed end being fixed on the first movable seat, the first movable seat including a first slide-assistance portion, the first pull cord passing through the first slide-assistance portion, and the first free end being exposed out of the first slide-assistance portion.

By changing a relative position between the first movable seat and the first guiding piece, the position of the first slide-assistance portion on the base frame can be changed.

The abovementioned first transmission unit includes a first pulley set. The first pulley set includes a first moving pulley and at least one first fixed pulley. The first pull cord wraps around the first moving pulley and the first fixed pulley. The first retracting unit includes a first retractor and a first connecting piece, and the first connecting piece is connected to the first retractor and the first moving pulley.

The abovementioned recumbent portion is extended in the horizontal direction and includes a first pad and a second pad. The first pad is provided with a first surface, the second pad is provided with a second surface, an included angle is disposed between the first surface and the second surface, and the included angle is between 0° and 180°.

The abovementioned first guiding piece is extended in the horizontal direction and includes a first positioning rod and a first slide rail. The first movable seat is provided with a first positioning seat corresponding to the first positioning rod, the first positioning seat is provided with a first positioning member, the first positioning member is selectively positioned on the first positioning rod, the first movable seat is provided with a first slide seat corresponding to the first slide rail, and the first slide seat holds the first slide rail. When the first positioning member is no longer positioned on the first positioning rod, the first movable seat slides on the first guiding piece by the first slide seat.

The abovementioned first positioning rod is provided axially with plural first positioning holes. The first positioning member is a first positioning pin, and the first positioning pin is inserted into or removed from the first positioning hole, corresponding to the first positioning hole.

The abovementioned first movable seat includes a first movable seat roller, and the first pull cord wraps around the first movable seat roller and then passes through the first slide-assistance portion.

The abovementioned first slide-assistance portion is a first perforation or a first slide-assistance roller.

The abovementioned first slide-assistance roller is pivoted on a first slide-assistance roller seat, and the first slide-assistance roller seat is rotatably fixed on the first movable seat.

The abovementioned base frame is provided with a first side and an opposite second side in the horizontal direction. The first side is provided with a bracket, the bracket is provided with at least one first side roller, and the first free end selectively passes through the first side roller and is fixed on a handle, allowing the first pull cord to move on the first side roller.

The abovementioned base frame is provided with a first side and an opposite second side in the horizontal direction. The second side is provided with at least one second side roller, and the first free end selectively passes through the second side roller and is fixed on a handle, allowing the first pull cord to move on the second side roller.

A pull rod is further provided, and the pull rod is provided with a pull rod combination portion. The first free end is selectively fixed on the pull rod combination portion.

At least one wearing piece is provided. The wearing piece is provided with a wearing piece combination portion, and the first free end is selectively fixed on the wearing piece combination portion.

The abovementioned exercising device is further provided with a second transmission unit, a second retracting unit, a second guiding piece, and a second movable seat.

The second transmission unit is disposed on the base frame and includes a second pull cord. The second pull cord includes a second free end and a second fixed end.

The second retracting unit is disposed on the base frame and is connected to the second transmission unit.

The second guiding piece is disposed on the base frame.

The second movable seat selectively moves on or is fixed on the second guiding piece. The second fixed end is fixed on the second movable seat, the second movable seat includes a second slide-assistance portion, the second pull cord passes through the second slide-assistance portion, and the second free end is exposed out of the second slide-assistance portion.

By changing a relative position between the second movable seat and the second guiding piece, the position of the second slide-assistance portion on the base frame can be changed.

The abovementioned second transmission unit includes a second pulley set, and the second pulley set includes a second moving pulley and at least one second fixed pulley. The second pull cord wraps around the second moving pulley and the second fixed pulley. The second retracting unit includes a second retractor and a second connecting piece, and the second connecting piece is connected to the second retractor and the second moving pulley.

The abovementioned recumbent portion is extended in the horizontal direction and includes a first pad and a second pad. The first pad is provided with a first surface, the second pad is provided with a second surface, an included angle is disposed between the first surface and the second surface, and the included angle is between 0° and 180°.

The abovementioned second guiding piece is extended in the horizontal direction and includes a second positioning rod and a second slide rail. The second movable seat is provided with a second positioning seat corresponding to the second positioning rod, the second positioning seat is provided with a second positioning member, the second positioning member is selectively positioned on the second positioning rod, the second movable seat is provided with a second slide seat corresponding to the second slide rail, and the second slide seat holds the second slide rail. When the second guiding piece is no longer positioned on the second positioning rod, the second movable seat slides on the second guiding piece by the second slide seat.

The abovementioned second positioning rod is provided axially with plural second positioning holes, the second positioning member is a second positioning pin, and the second positioning pin is inserted into or removed from the second positioning hole, corresponding to the second positioning hole.

The abovementioned second movable seat includes a second movable seat roller, the second pull cord wraps around the second movable seat roller and then passes through the second slide-assistance portion.

The abovementioned second slide-assistance portion is a second perforation or a second slide-assistance roller.

The abovementioned second slide-assistance roller is pivoted on a second slide-assistance roller seat, and the second slide-assistance roller seat is rotatably fixed on the second movable seat.

The abovementioned base frame is provided with a first side and an opposite second side in the horizontal direction. The first side is provided with a bracket, the bracket is provided with at least one first side roller, and the second free end selectively passes through the first side roller and is fixed on a handle, allowing the second pull cord to move on the first side roller.

The abovementioned base frame is provided with a first side and an opposite second side in the horizontal direction. The second side is provided with at least one second side roller, and the second free end selectively passes through the second side roller and is fixed on a handle, allowing the second pull cord to move on the second side roller.

A pull rod is further provided. The pull rod includes a pull rod combination portion, and the abovementioned second free end is selectively fixed on the pull rod combination portion.

The abovementioned exercising device is further provided with at least one wearing piece. The wearing piece is provided with a wearing piece combination portion, and the second free end is selectively fixed on the wearing piece combination portion.

The abovementioned technical features are preferably provided with following advantages:

1. The exercising device can be used separately in a training mode where an operator lies down to lift weight.
2. The exercising device can be used separately in a rowing mode for training.
3. The exercising device can be used separately as dumbbells for training.
4. The exercising device can be used separately in a training mode where an operator sits and pulls in an inclined direction.
5. The exercising device can be used separately in a training mode for lifting legs.
6. By changing the relative position between the movable seat and the guiding piece, the position of the slide-assistance portion on the base frame can be changed, so that an operator can apply force on the first side or second side of the base frame for training, thereby selecting various kinds of training modes.
7. By integrating various kinds of training modes in a same exercising device for use, the size of the exercising device can be reduced without taking up space, and the operation modes can be diversified.

To enable a further understanding of the said objectives and the technological methods of the invention herein, the brief description of the drawings below is followed by the detailed description of the preferred embodiments.

DETAILED DESCRIPTION OF THE PREFERRED EMBODIMENTS

Figure 12:
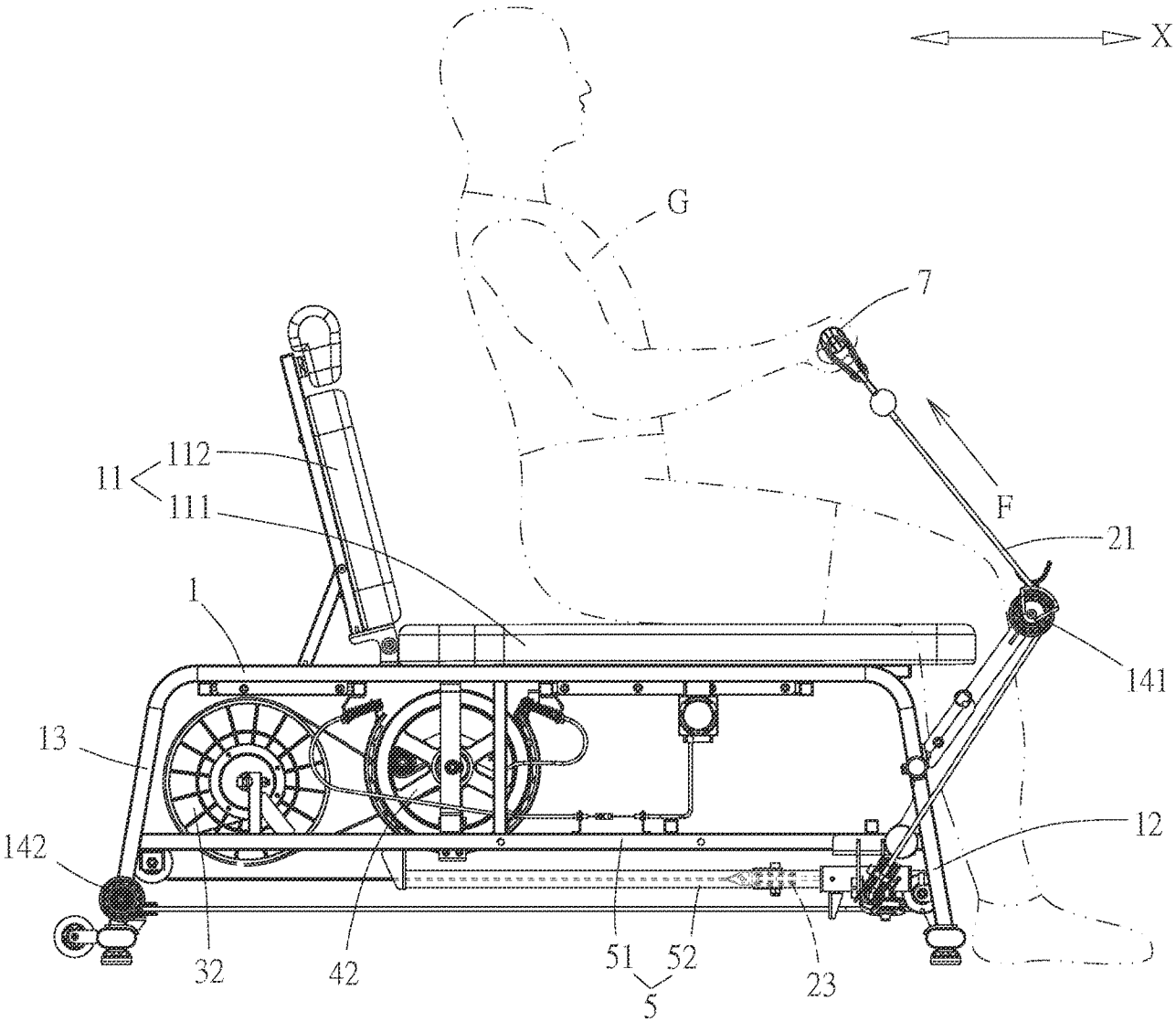
FIG. 12 shows a schematic view of the present embodiment used in a rowing mode for training.
Figure 13:
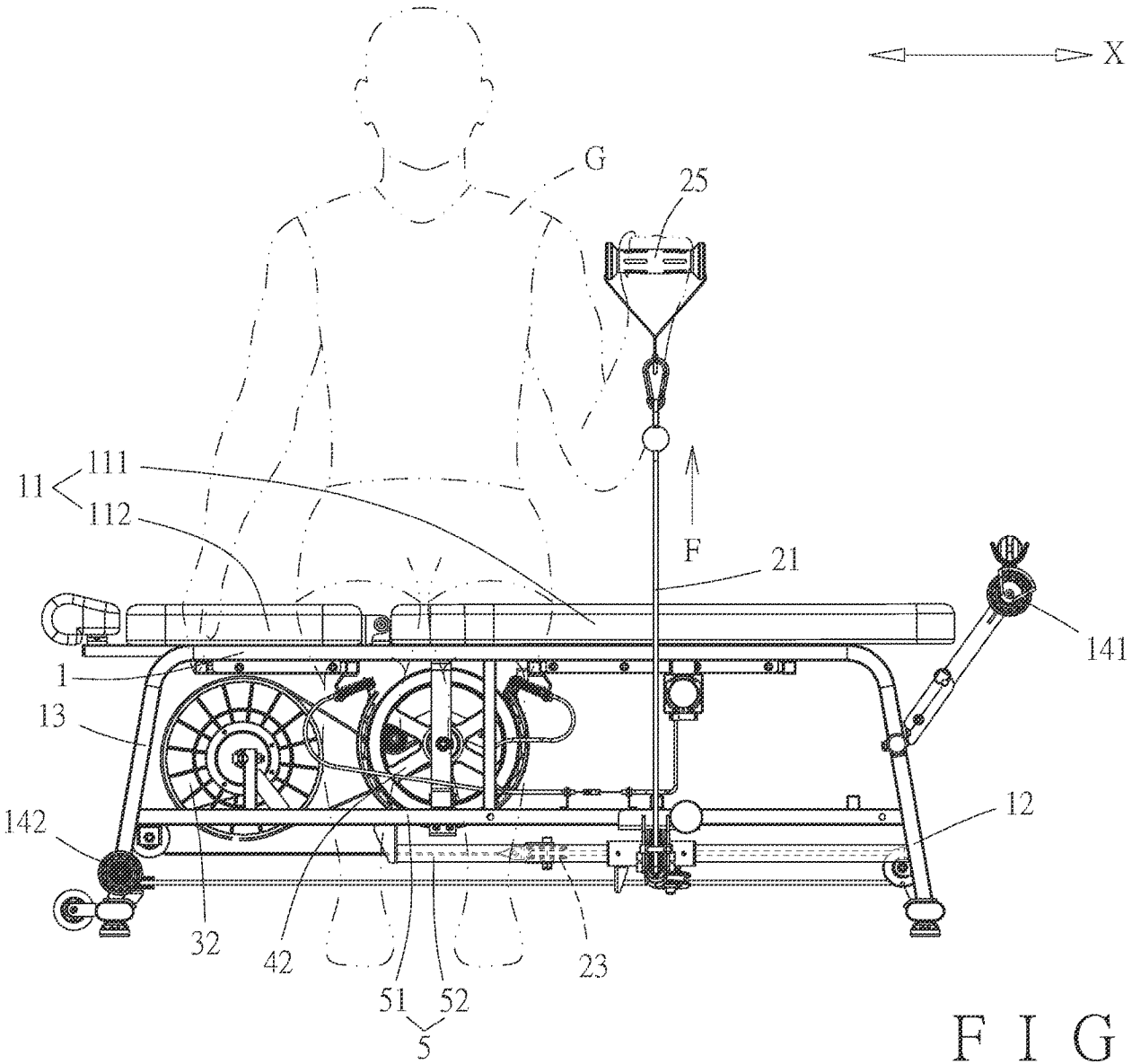
FIG. 13 shows a schematic view of the present embodiment used as dumbbells for training.
Figure 14:
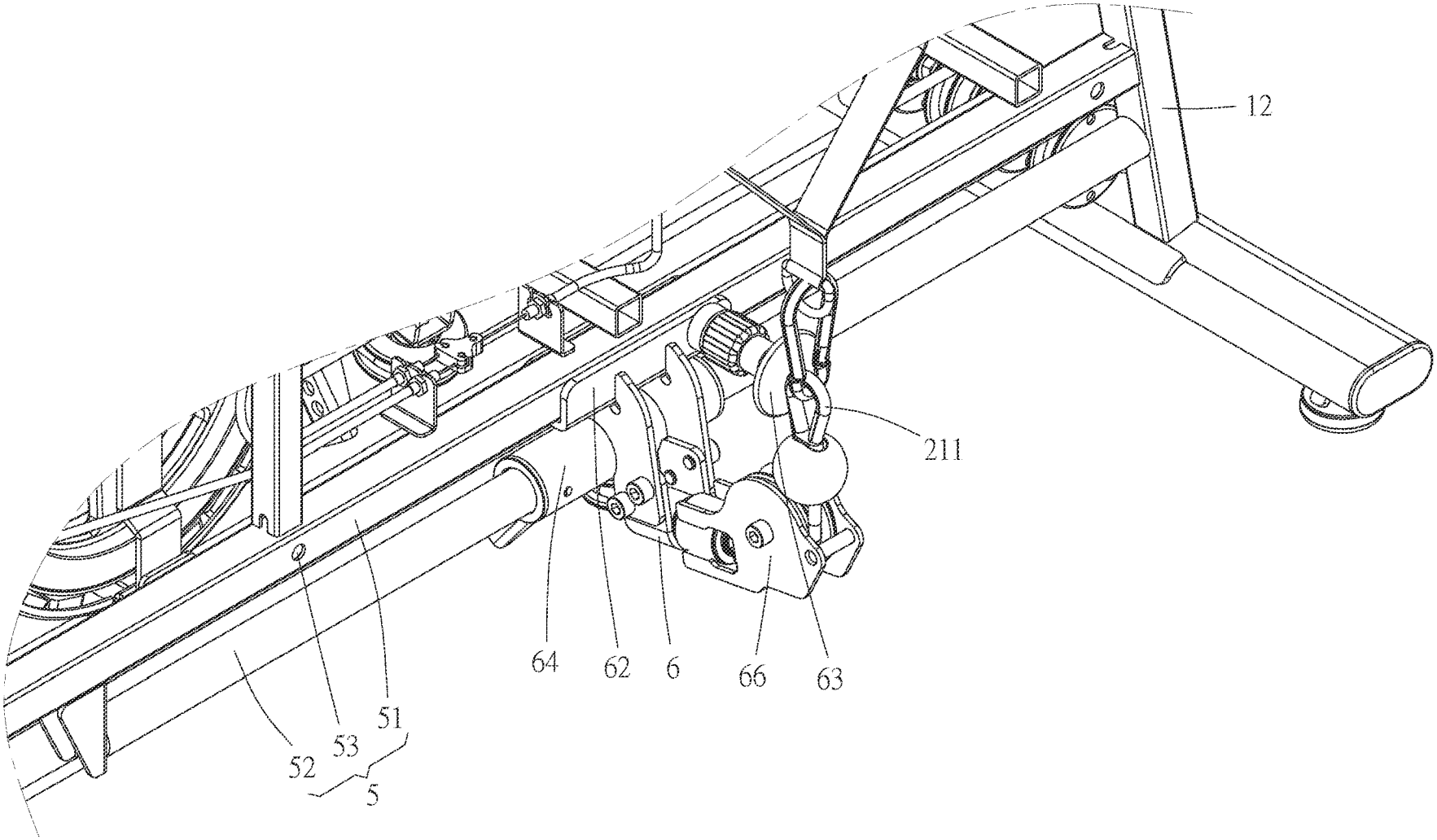
FIG. 14 shows a schematic view of the movable seat changing a position relative to the guiding piece, according to the present embodiment.

In the following embodiment, the terms of direction, such as left, right, front, rear, up and down, are all the relative orientations that an operator G (as shown in FIG. 12) feels when he or she sits down on a first pad 111 of a base frame 1 of the present invention, with an upper body in an upright posture and two eyes looking forward. These terms of direction are only used as a convenient way to describe the present embodiment and are not meant to limit the spatial configurations of the present invention.

Figure 1:
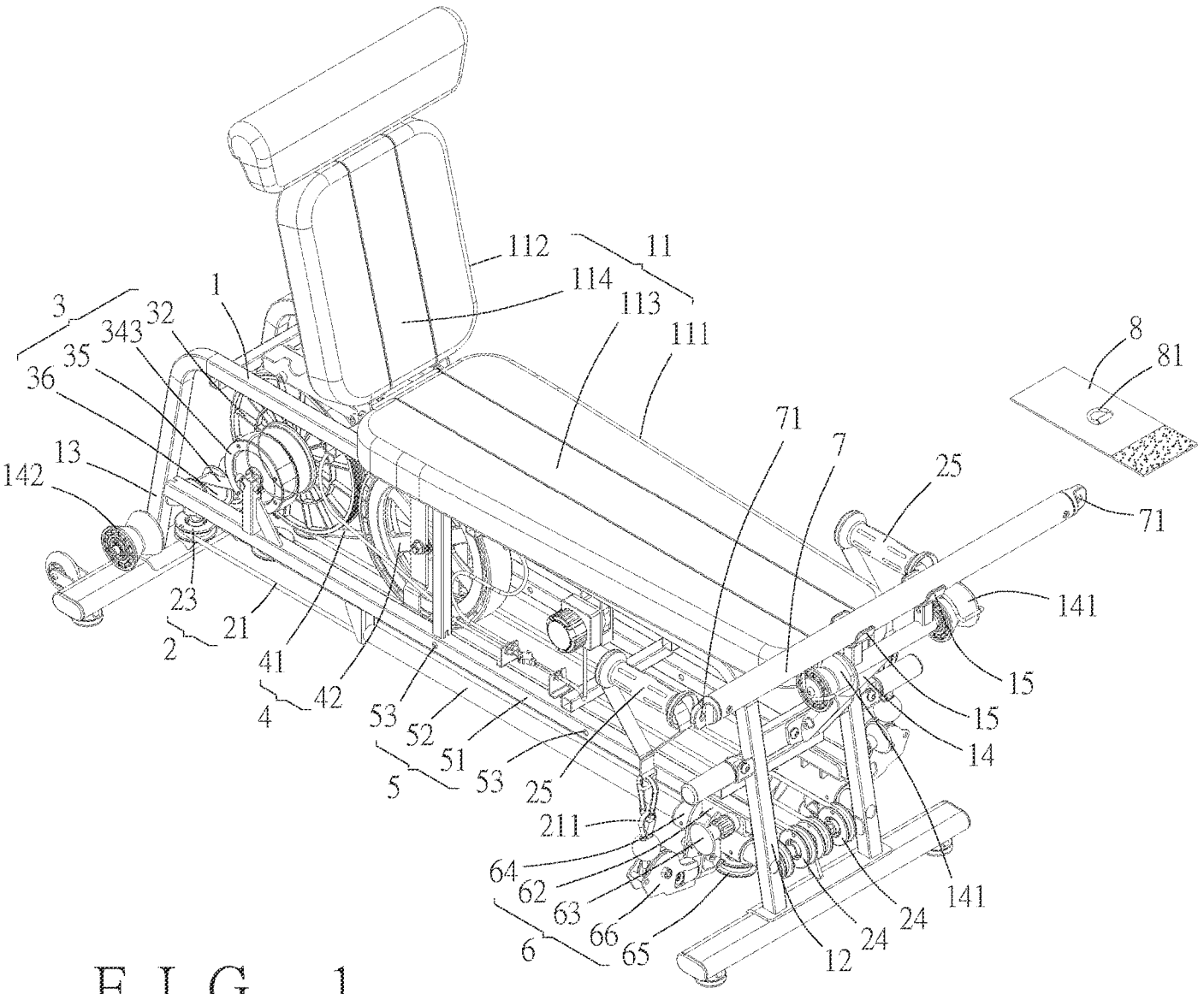
FIG. 1 shows a perspective view of the present embodiment.
Figure 2:
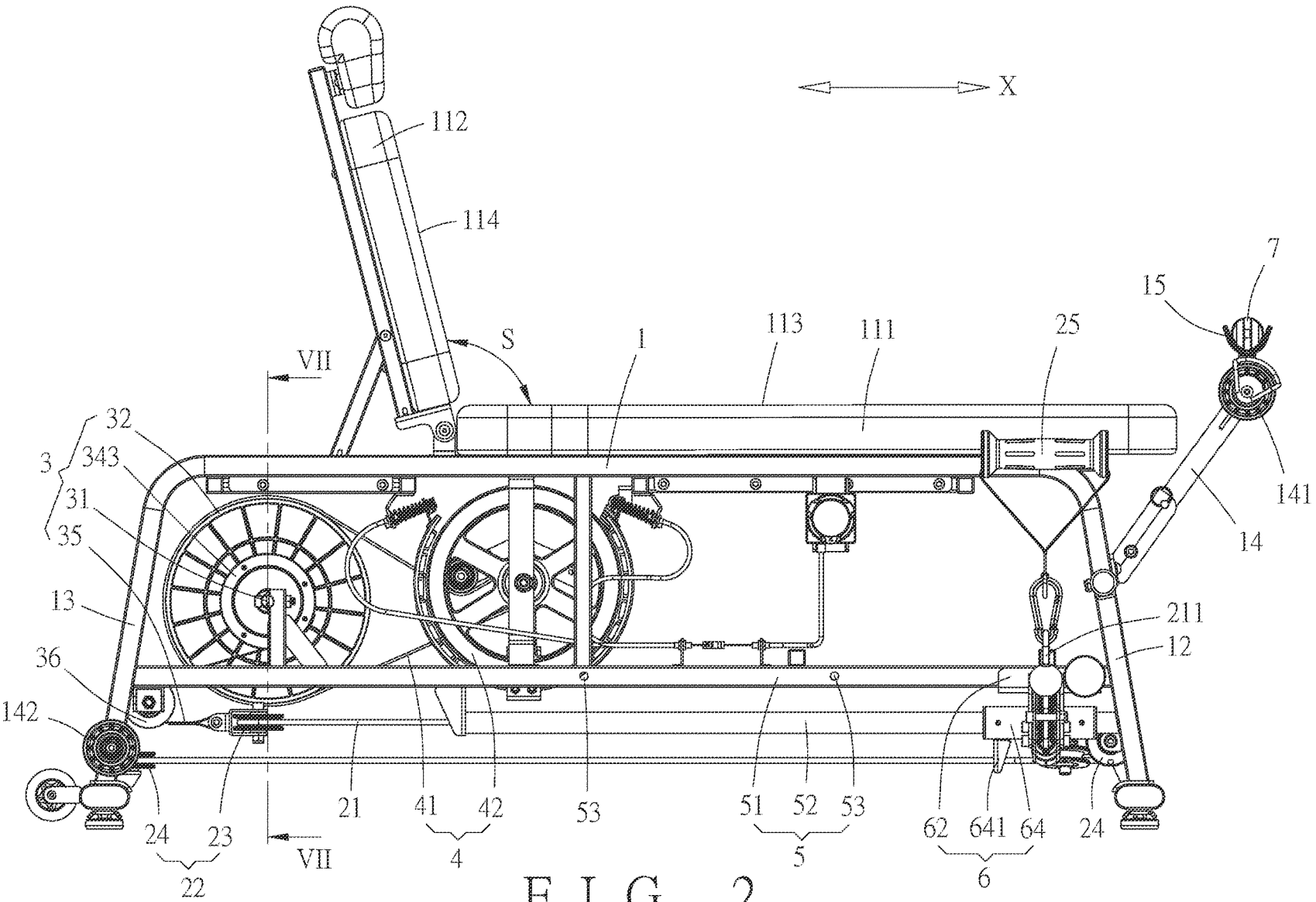
FIG. 2 shows a front view of the present embodiment.
Figure 3:
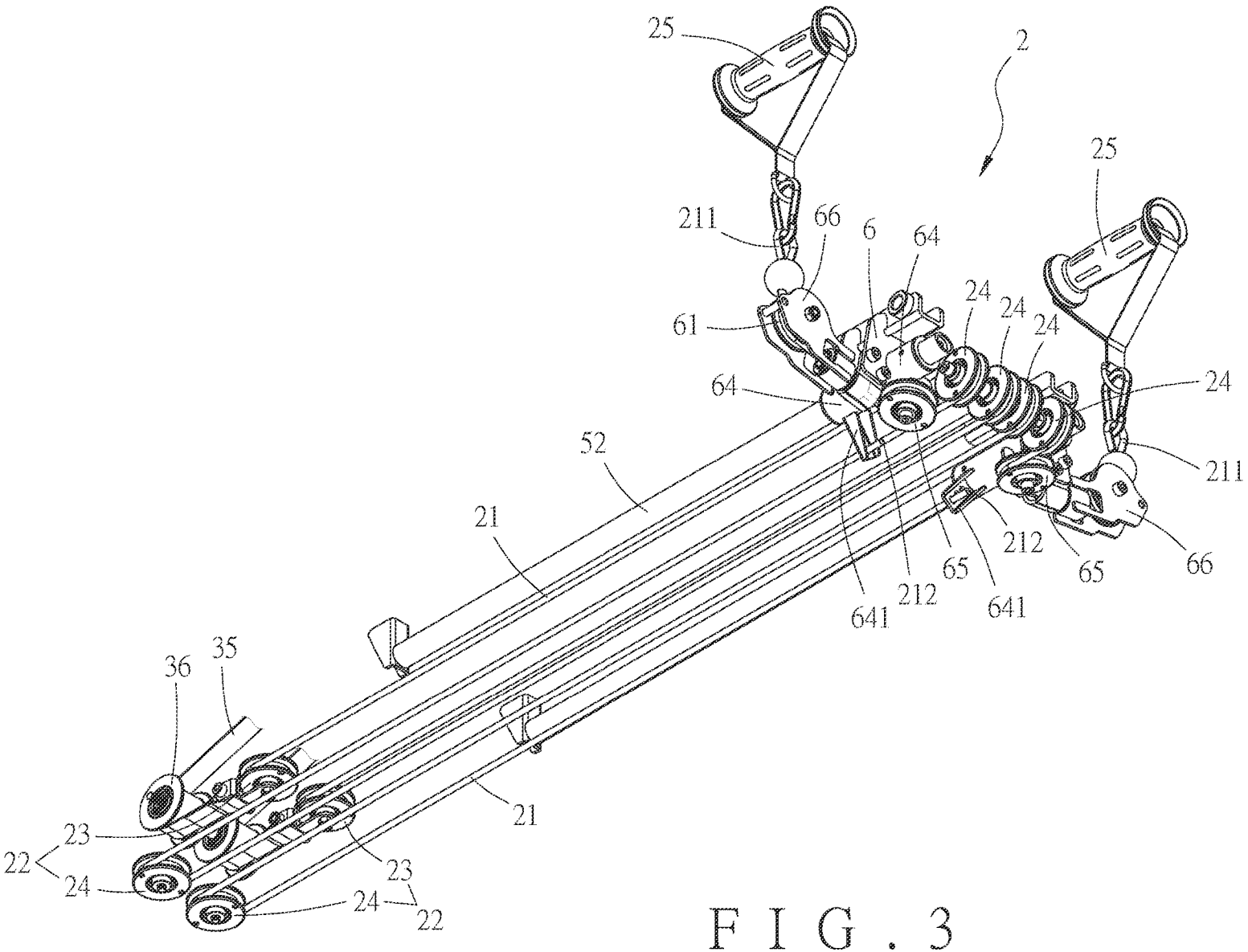
FIG. 3 shows a perspective view of part of components, according to the present embodiment.

Referring to FIG. 1, FIG. 2, and FIG. 3, the present embodiment comprises a base frame 1, a transmission unit 2, a retracting unit 3, a resistance unit 4, a guiding piece 5, a movable seat 6, a pull rod 7 and a wearing piece 8.

The base frame 1 is extended in a horizontal direction X and includes a recumbent portion 11. The recumbent portion 11 is extended in the horizontal direction X and includes a first pad 111 and a second pad 112. The first pad 111 and the second pad 112 can be raised and positioned in multiple stages. The first pad 111 is provided with a first surface 113, the second pad 112 is provided with a second surface 114, an included angle S is disposed between the first surface 113 and the second surface 114, and the included angle S is between 0° and 180°. The base frame 1 is provided with a first side 12 and an opposite second side 13 in the horizontal direction X, the first side 12 is provided with a bracket 14, the bracket 14 is provided with at least one first side roller 141, the second side 13 of the base frame 1 is provided with at least one second side roller 142, and a top of the bracket 14 is provided with an accommodation portion 15.

Figure 4:
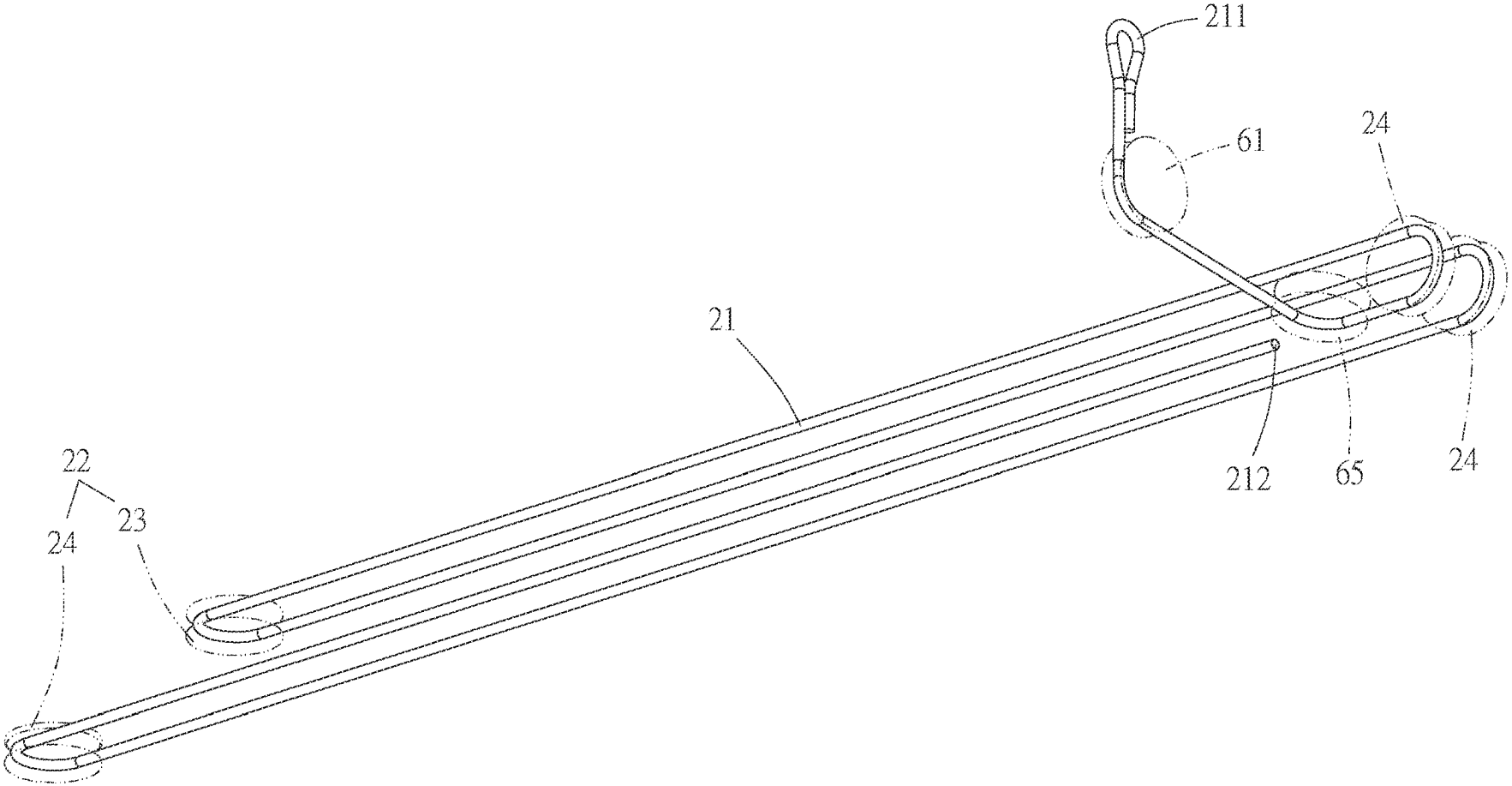
FIG. 4 shows a simple schematic view of configuration of a pull cord and a pulley set, according to the present embodiment.
Figure 5:
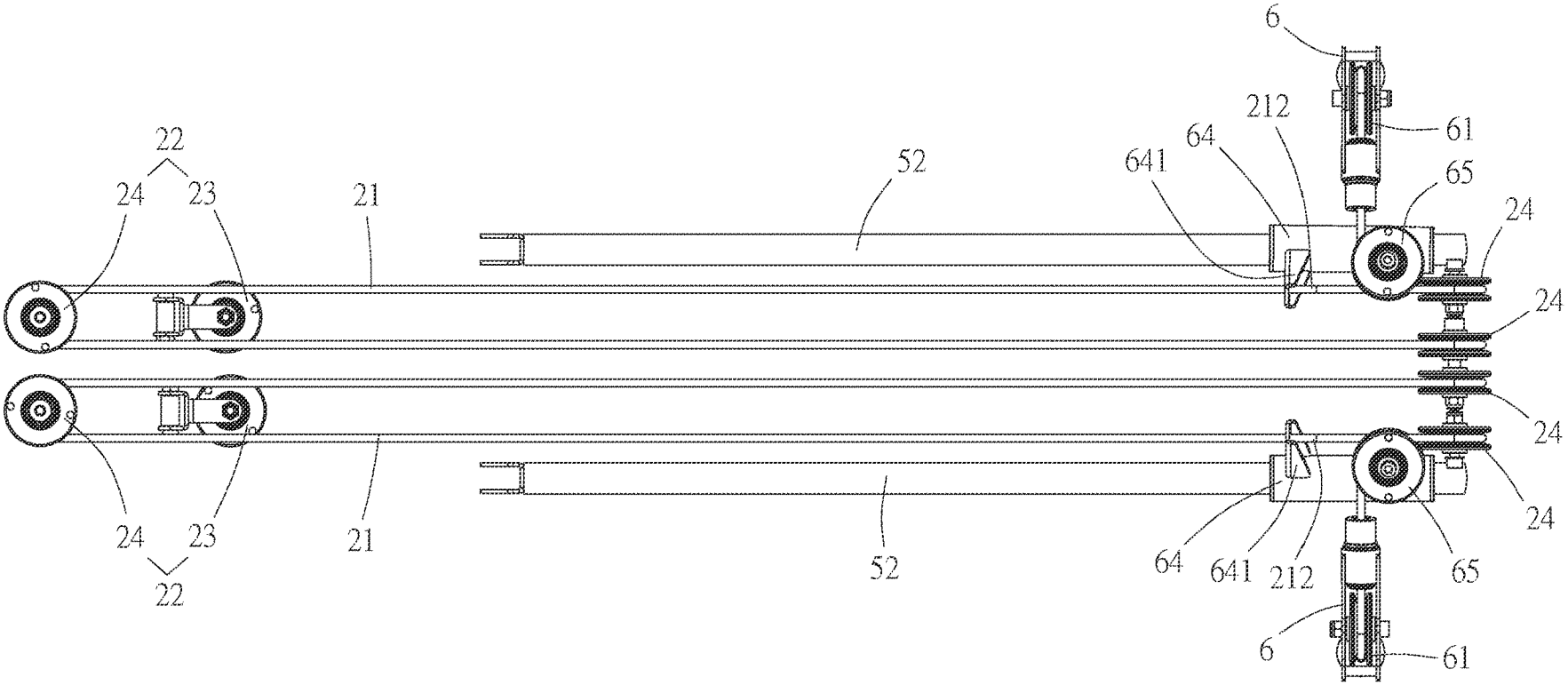
FIG. 5 is a schematic view of structures of the pull cord and pulley set, according to the present embodiment.
Figure 6:
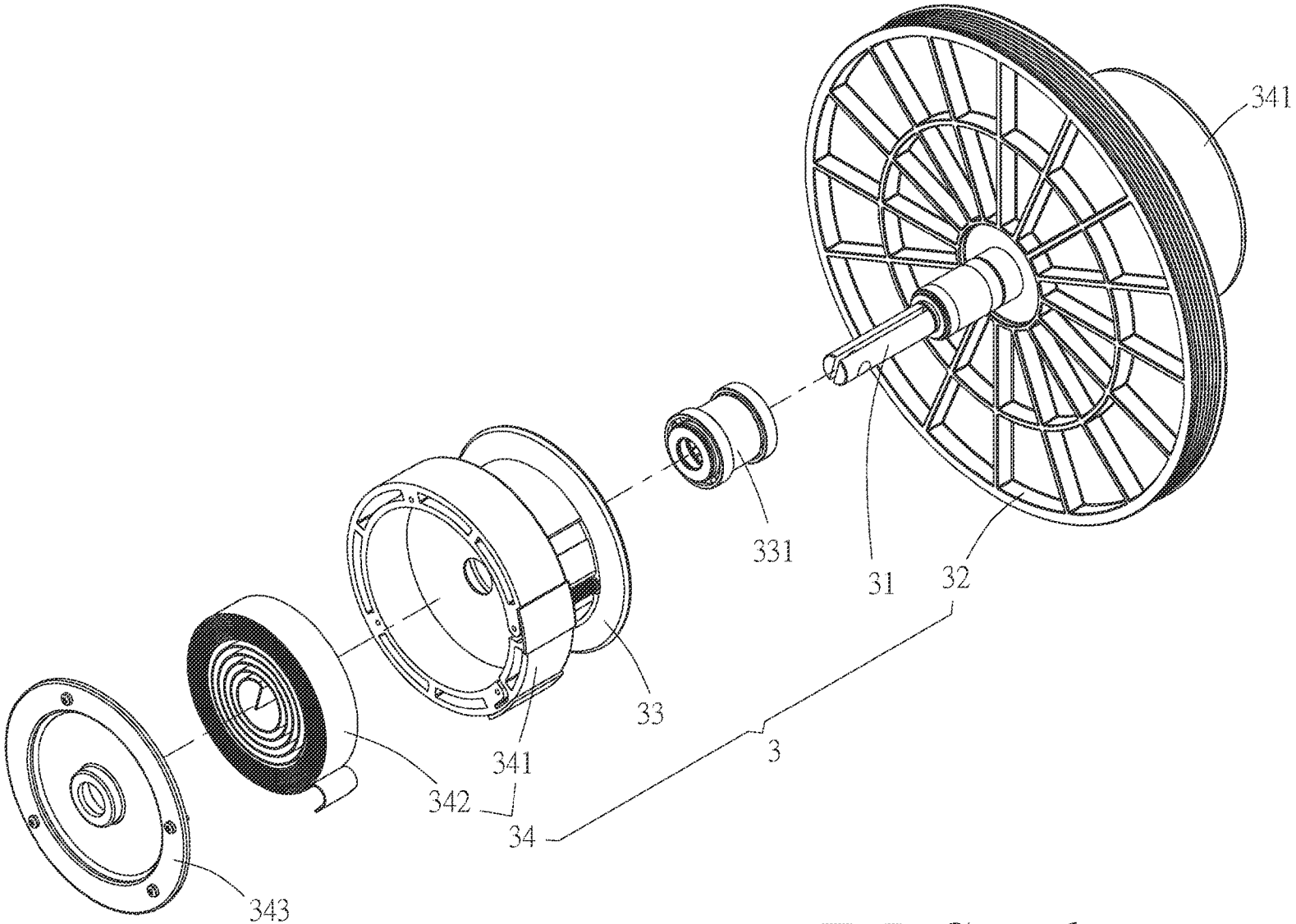
FIG. 6 shows a partially perspective exploded view of a retracting unit, according to the present embodiment.
Figure 7:
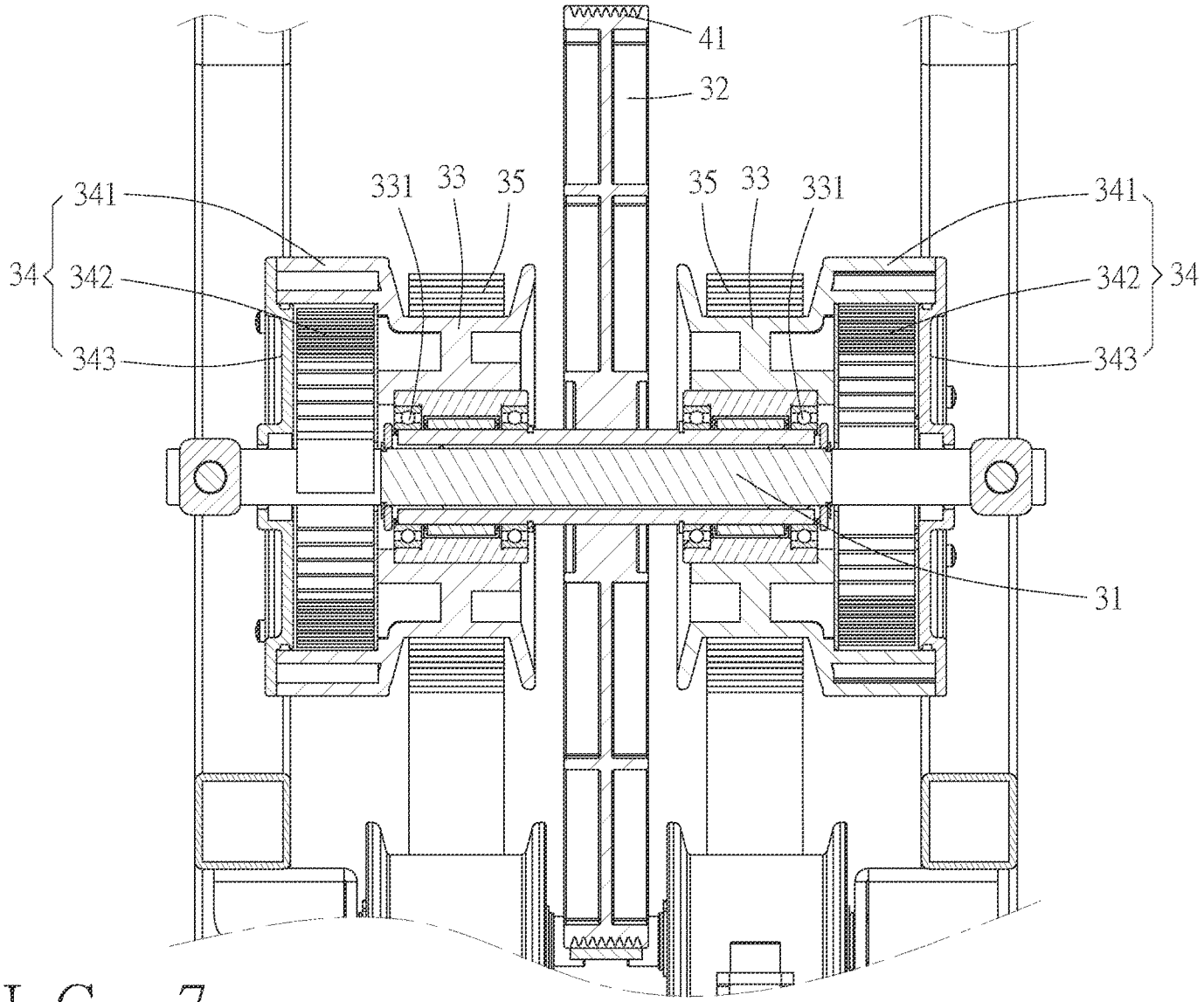
FIG. 7 shows a sectional view taken along the line VII-VII in FIG. 2, according to the present embodiment.

The transmission unit 2 is disposed on the base frame 1. As shown in FIG. 2, FIG. 4, and FIG. 5, the transmission unit 2 includes at least one pull cord 21 and one pulley set 22. The pulley set 22 includes a moving pulley 23 and at least one fixed pulley 24. The pull cord 21 includes a free end 211 and a fixed end 212, and the free end 211 passes through the first side roller 141 selectively, allowing the pull cord 21 to move on the first side roller 141; or, the free end 211 passes through the second side roller 142 selectively, allowing the pull cord 21 to move on the second side roller 142. In addition, the free end 211 is selectively fixed on a handle 25. The pull cord 21 wraps around the moving pulley 23 and the fixed pulleys 24. The fixed pulleys 24 are fixed respectively on the first side 12 and the second side 13 of the base frame 1. The moving pulley 23 follows the linking of the pull cord 21 and moves between the first side 12 and the second side 13. In the present embodiment, the base frame 1 is provided with two transmission units 2, which are a first transmission unit and a second transmission unit.

The retracting unit 3 is disposed on the base frame 1. As shown in FIG. 3, FIG. 6, FIG. 7 and FIG. 8, the retracting unit 3 links with the transmission unit 2. The retracting unit 3 includes a spindle 31, a transmission wheel 32, a one-way wheel 33, a retractor 34, a connecting piece 35 and an auxiliary pulley 36. The spindle 31 is pivoted on the base frame 1, and the transmission wheel 32 is fixed on the spindle 31. A one-way bearing 331 is disposed between the one-way wheel 33 and the spindle 31; whereas, by the one-way bearing 331, the one-way wheel 33 drives the spindle 31 in a first rotation direction R1 and rotates idly on the spindle 31 in a second rotation direction R2, with the first rotation direction R1 being opposite to the second rotation direction R2. The retractor 34 is connected to the spindle 31 and includes a casing 341 and a volute spring 342. An end of the volute spring 342 is fixed on an inner wall of the casing 341, and the other end of the volute spring 342 is fixed on the spindle 31. And then, the casing 341 is closed by a sealing cap 343. One end of the connecting piece 35 wraps around the one-way wheel 33 and is fixed; whereas, the other end of the connecting piece 35 wraps around the auxiliary pulley 36 and is connected fixedly to the moving pulley 23. The auxiliary pulley 36 is fixed on the second side 13 of the base frame 1. When an operation force is applied to allow the spindle 31 to rotate in the first rotation direction R1, by providing the one-way bearing 331 between the one-way wheel 33 and the spindle 31, the one-way wheel 33 can be driven to rotate in the first rotation direction R1, through the one-way bearing 331. In a mean time, the retractor 34 will accumulate a restoring force. When the operation force decreases or disappears, through the one-way bearing 331, the restoring force is used to drive the one-way wheel 33 to rotate idly on the spindle 31 in the second rotation direction R2, thereby retracting the connecting piece 35. In the present embodiment, the base frame 1 is provided with two retracting units 3, which are a first retracting unit and a second retracting unit. The two retracting units 3 commonly use one spindle 31 and one transmission wheel 32.

Figure 8:
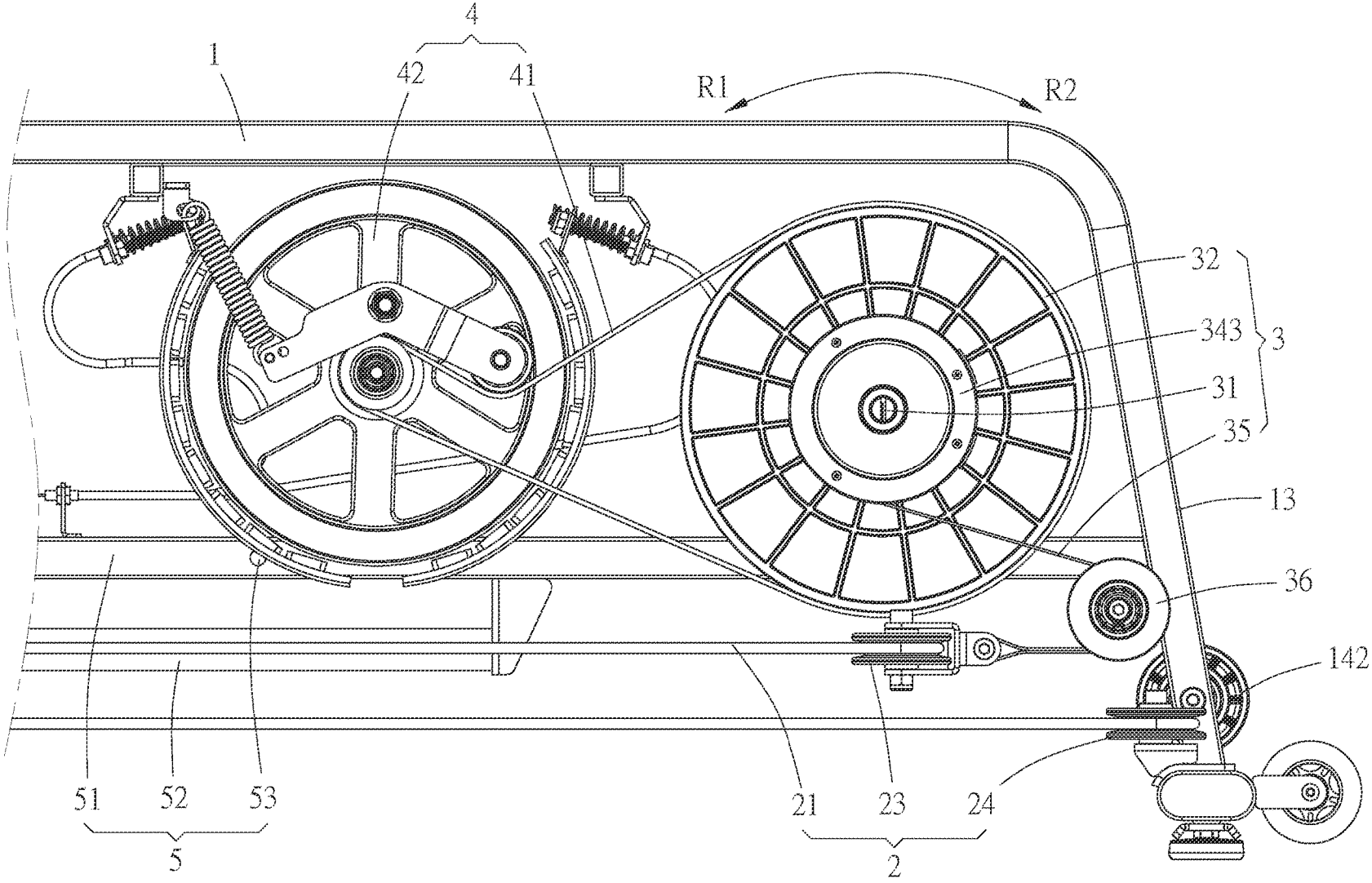
FIG. 8 shows a structural view of a resistance unit, according to the present embodiment.

The resistance unit 4 is disposed on the base frame 1. As shown in FIG. 1, FIG. 2 and FIG. 8, the resistance unit 4 is connected to the spindle 31, allowing the spindle 31 to be equipped with a rotation resistance. The resistance unit 4 includes a resistance connecting piece 41 and a resistor 42. The resistor 42 is fixed on the base frame 1, whereas the resistance connecting piece 41 is connected to the transmission wheel 32 and the resistor 42. The resistor 42 is used to generate the rotation resistance and is a magnetic resistor, a friction force resistor, an air resistor, a liquid resistor, a motor or an electromagnetic braking resistor.

Figure 9:
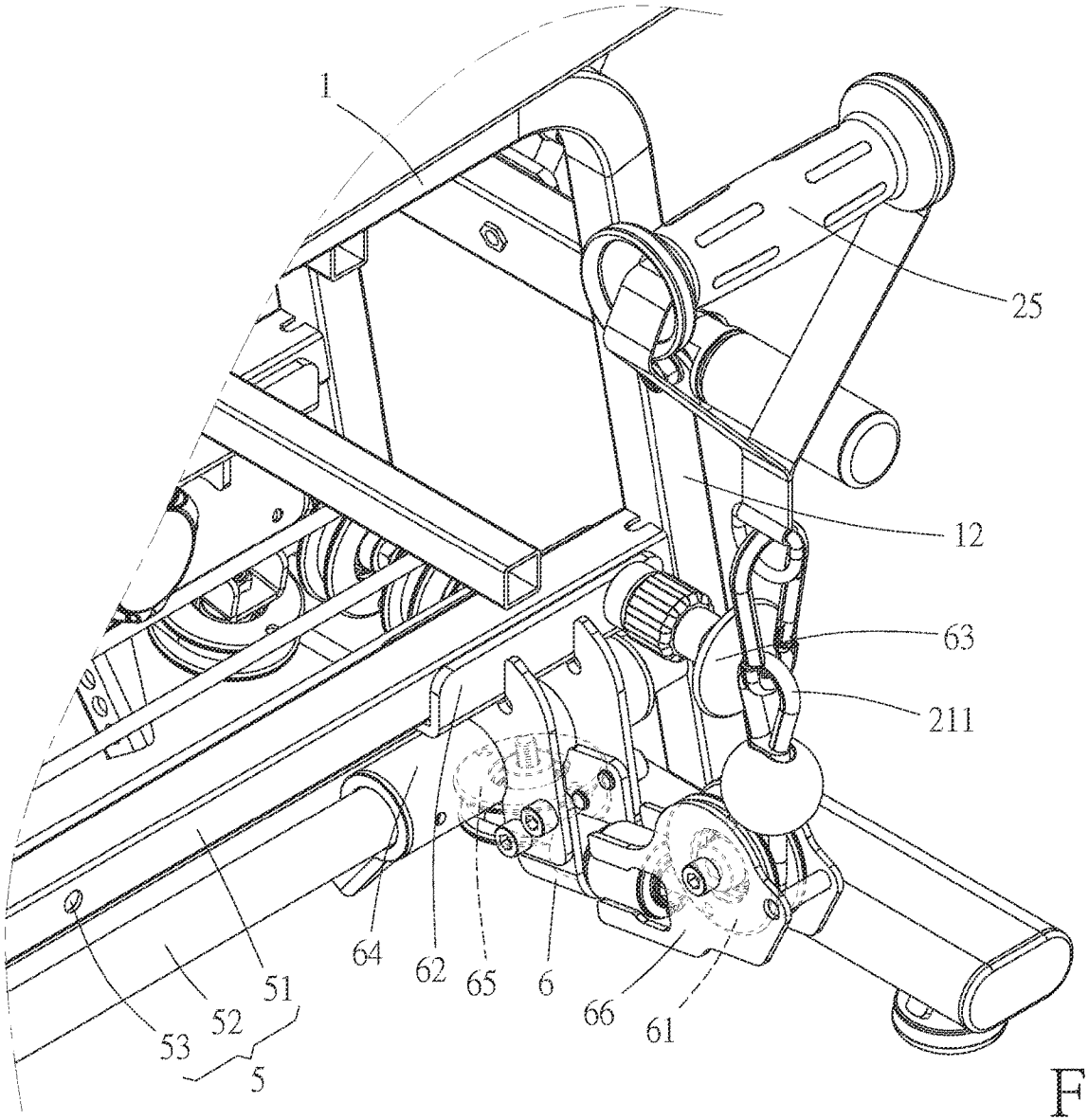
FIG. 9 is a partially structural view of a guiding piece and a movable seat, according to the present embodiment.

The guiding piece 5 is disposed on the base frame 1 and is extended in the horizontal direction X. As shown in FIG. 1, FIG. 3 and FIG. 9, the guiding piece 5 includes a positioning rod 51 and a slide rail 52. The positioning rod 51 is provided axially with plural positioning holes 53. In the present embodiment, the base frame 1 is provided with two guiding pieces 5, which are a first guiding piece and a second guiding piece.

Referring to FIG. 1, FIG. 2, FIG. 3 and FIG. 9, the movable seat 6 selectively moves on or is fixed on the guiding piece 5. The movable seat 6 includes a slide-assistance portion 61, the pull cord 21 passes through the slide-assistance portion 61, and the free end 211 is exposed to out of the slide-assistance portion 61. The movable seat 6 is provided with a positioning seat 62 corresponding to the positioning rod 51, the positioning seat 62 is provided with a positioning member 63, and the positioning member 63 is selectively positioned on the positioning rod 51. The movable seat 6 is provided with a slide seat 64 corresponding to the slide rail 52, and the slide seat 64 holds the slide rail 52. When the positioning member 63 is no longer positioned on the positioning rod 51, the movable seat 6 slides on the guiding piece 5 by the slide seat 64. The positioning member 63 is a positioning pin, and the positioning pin is inserted into or removed from the positioning hole 53, corresponding to any positioning hole 53. The slide seat 64 is provided with a securing portion 641 to fix the fixed end 212 of the pull cord 21. The movable seat 6 includes a movable seat roller 65, and the free end 211 of the pull cord 21 wraps around the movable seat roller 65 and then passes through the slide-assistance portion 61. The slide-assistance portion 61 is a perforation or a slide-assistance roller. The slide-assistance roller is pivoted on a slide-assistance roller seat 66, and the slide-assistance roller seat 66 is rotatably fixed on the movable seat 6. By changing a relative position between the movable seat 6 and the guiding piece 5, the position of the slide-assistance portion 61 on the base frame 1 can be changed. In the present embodiment, two guiding pieces 5 are provided with two movable seats 6, which are a first movable seat and a second movable seat.

The pull rod 7 can be placed on the accommodation portion 15 of the base frame 1. The pull rod 7 is provided with a pull rod combination portion 71, and the free end 211 is selectively fixed on the pull rod combination portion 71.

The wearing piece 8 is provided with a wearing piece combination portion 81, and the free end 211 is selectively fixed on the wearing piece combination portion 81; whereas the wearing piece 8 is a zip tie.

Figure 10:
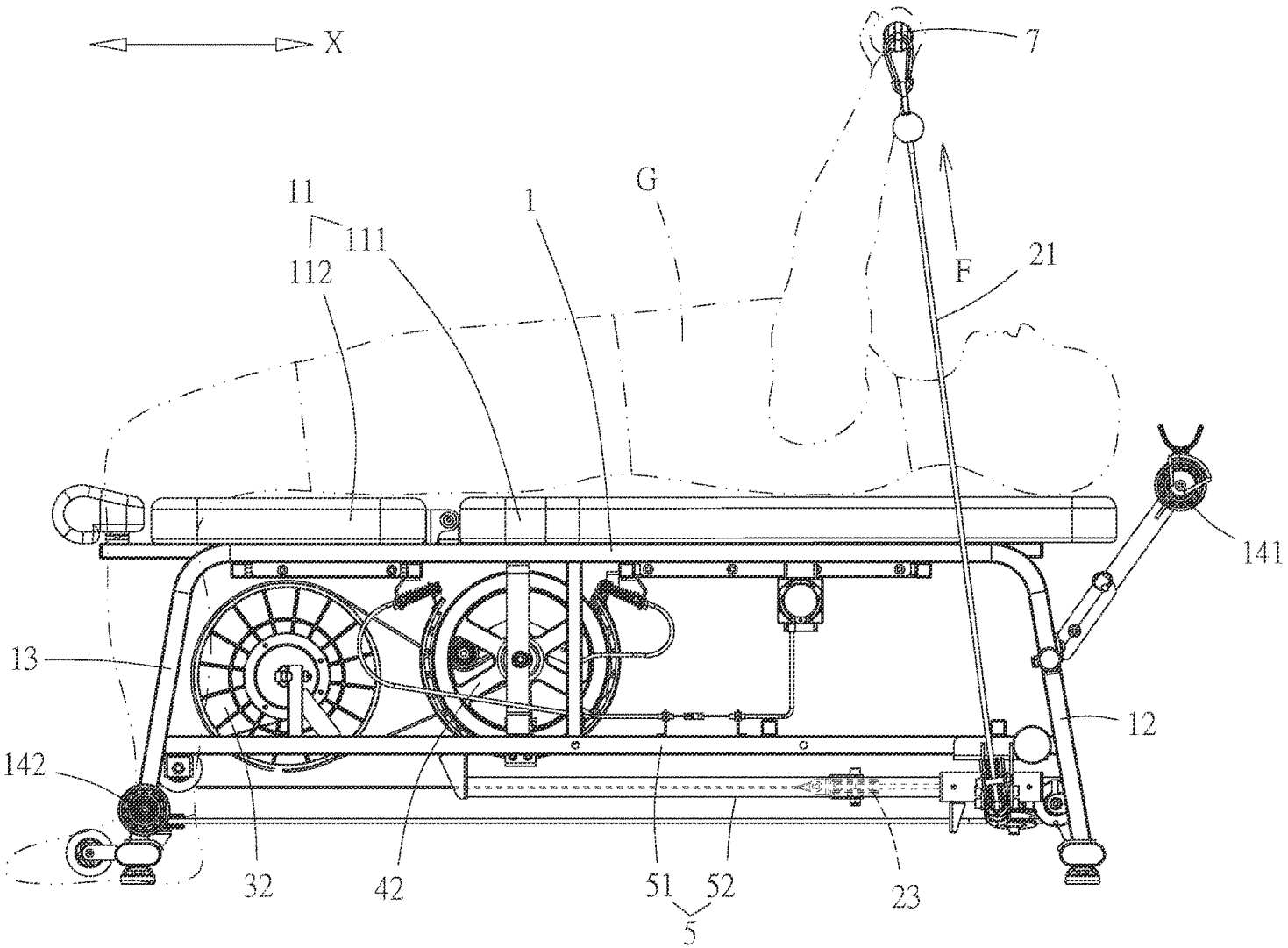
FIG. 10 shows a schematic view of the present embodiment used in a training mode where an operator lies down to lift weight.
Figure 11:
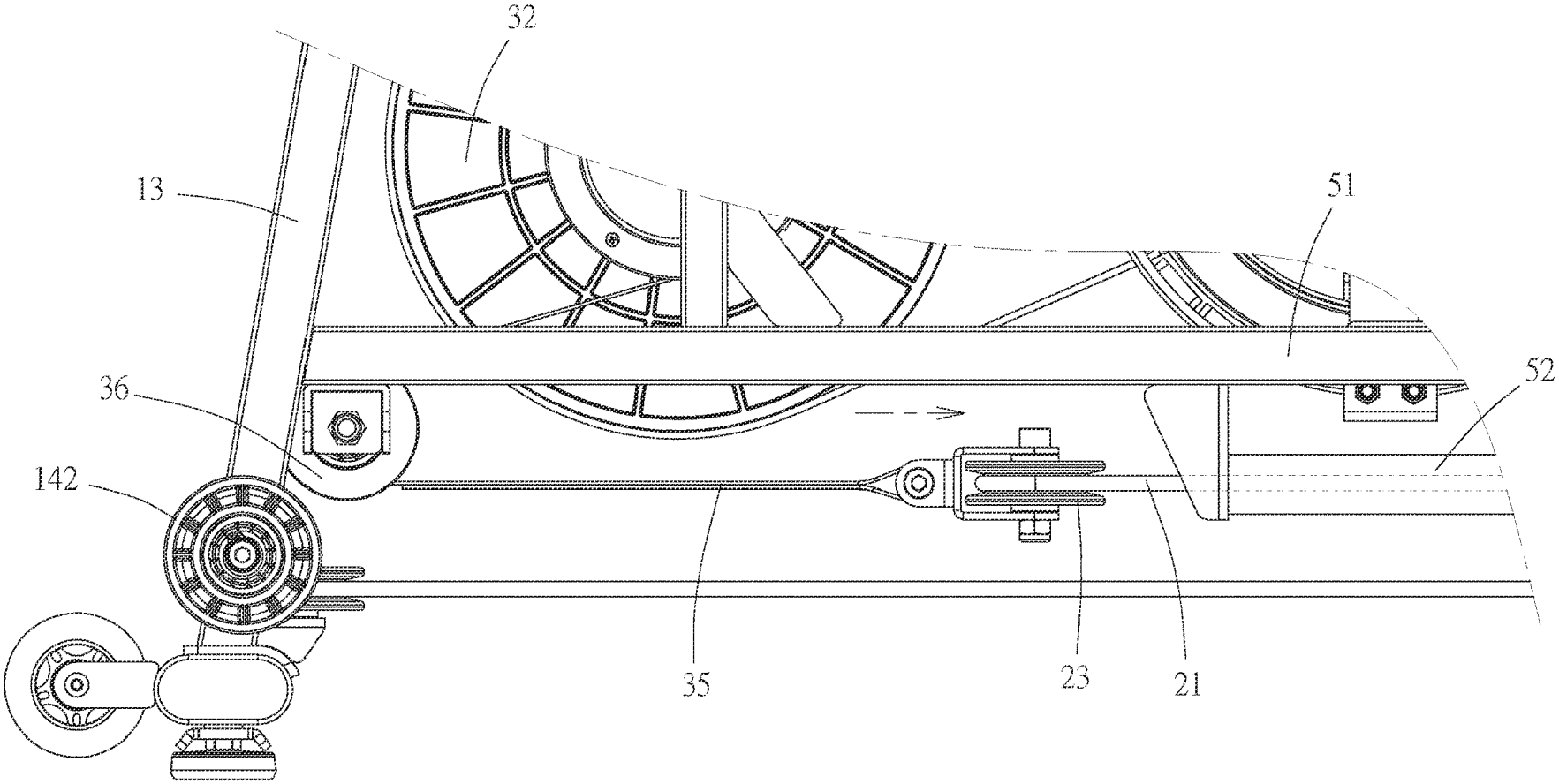
FIG. 11 shows a schematic view of the pull cord linking with a moving pulley to move, according to the present embodiment.

When the present invention is used in a training mode where an operator G lies down to lift weight, as shown in FIG. 1, FIG. 9 and FIG. 10, first the pull rod combination portion 71 of the pull rod 7 is fixed on the free end 211 of the pull cord 21. The operator G lies down flat, with his or her chest facing upward, on the recumbent portion 11 of the base frame 1, suspends both legs naturally on the second side 13 of the base frame 1, and then uses both hands to hold the pull rod 7 and applies a force to push up the pull rod 7, so as to apply an operation force F to the two pull cords 21 to pull the two pull cords 21.

Referring to FIG. 2, FIG. 7, FIG. 8 and FIG. 11, next, by that the pull cord 21 links with the moving pulley 23 to move between the fixed pulleys 24, the moving pulley 23 can move to the first side 12 from the second side 13 in the horizontal direction X, and pull the connecting piece 35 at a same time, thereby driving the one-way wheel 33 of the retracting unit 3 to rotate in the first rotation direction R1, so as to drive the spindle 31 to rotate in the first rotation direction R1. When the spindle 31 rotates in the first rotation direction R1, by the one-way bearing 331, the spindle 31 can drive the transmission wheel 32 to rotate in the first rotation direction R1 and rotate the volute spring 342 at a same time, allowing the volute spring 342 to accumulate a restoring force. Through the resistance connecting piece 41, the transmission wheel 32 links with the resistor 42 to rotate, allowing the spindle 31 to be equipped with a rotation resistance. The rotation resistance can be transmitted to the pull rod 7 through the transmission unit 2, in order to train the operator G to lift weight in the lying posture. When the operator G no longer applies the force and puts down the pull rod 7, and the operation force F decreases or disappears, by the one-way bearing 331, the restoring force is used to drive the one-way wheel 33 to rotate idly on the spindle 31 in the second rotation direction R2, thereby retracting the connecting piece 35 to restore to its original location. By applying the force back and forth, it can achieve the function of training hands and chest.

When the present invention is used in a rowing mode for training, as shown in FIG. 1, FIG. 9 and FIG. 12, the free end 211 of the pull cord 21 selectively wraps around the first side roller 141, allowing the pull cord 21 to move on the first side roller 141. The operator G sits on the first pad 111 of the recumbent portion 11, suspends both legs naturally on the first side 12 of the base frame 1, and then uses both hands to hold the pull rod 7 to apply a force to pull the pull rod 7 in a rear and upward direction, so as to apply an operation force F to the two pull cords 21 to pull the two pull cords 21.

Referring to FIG. 2, FIG. 7, FIG. 8 and FIG. 11, next, by that the pull cord 21 links with the connecting piece 35, the one-way wheel 33 of the retracting unit 3 is driven to rotate in the first rotation direction R1, and to drive the spindle 31 to rotate in the first rotation direction R1. By the one-way bearing 331, the spindle 31 can drive the transmission wheel 32 to rotate in the first rotation direction R1 and enable the volute spring 342 to accumulate a restoring force at a same time. By the resistance connecting piece 41, the transmission wheel 32 links with the resistor 42 to rotate, allowing the spindle 31 to be equipped with a rotation resistance. The rotation resistance is transmitted to the pull rod 7, in order to train the operator G for the rowing exercise. When the operator G no longer applies a force and puts down the pull rod 7, and the operation force F decreases or disappears, by the one-way bearing 331, the restoring force is used to drive the one-way wheel 33 to rotate idly on the spindle 31 in the second rotation direction R2, thereby retracting the connecting piece 35 to restore to its original location. By applying the force back and forth, it can achieve the function of training hands and chest.

When the present invention is used as dumbbells for training, as shown in FIG. 1, FIG. 9, FIG. 13 and FIG. 14, first a position of the movable seat 6 relative to the guiding piece 5 needs to be adjusted. The positioning member 63 is first taken out to escape from the positioning rod 51, allowing the slide seat 64 of the movable seat 6 to movably slide on the slide rail 52. The positioning seat 62 is made to move from the first side 12 to the second side 13 relative to the positioning rod 51. When the positioning seat 62 moves to a middle section of the positioning rod 51, the positioning member 63 is positioned in the positioning hole 53 on the positioning rod 51, thereby re-fixing the movable seat 6 on the guiding piece 5. Next, the free end 211 of the pull cord 21 is selectively changed to fix the handle 25. The operator G sits on the recumbent portion 11, suspends both legs naturally between the first side 12 and the second side 13 of the base frame 1, and uses one hand to hold the handle 25 to apply a force to pull up the handle 25, thereby applying an operation force F to the two pull cords 21 to pull the two pull cords 21.

Referring to FIG. 2, FIG. 7, FIG. 8 and FIG. 11, next, by that the pull cord 21 links with the connecting piece 35, the one-way wheel 33 of the retracting unit 3 is driven to rotate in the first rotation direction R1, in order to drive the spindle 31 to rotate in the first rotation direction R1. By the one-way bearing 331, the spindle 31 can drive the transmission wheel 32 to rotate in the first rotation direction R1 and allow the volute spring 342 to accumulate a restoring force at a same time. By the resistance connecting piece 41, the transmission wheel 32 links with the resistor 42 to rotate, allowing the spindle 31 to be equipped with a rotation resistance. The rotation resistance is transmitted to the handle 25, in order to train the operator G with a dumbbell exercise. When the operator G no longer applies force and puts down the handle 25, and the operation force F decreases or disappears, by the one-way bearing 331, the restoring force is used to drive the one-way wheel 33 to rotate idly on the spindle 31 in the second rotation direction R2, thereby retracting the connecting piece 35 to restore to its original location. By applying the force back and forth, it can achieve the function of training hands and chest.

Figure 15:
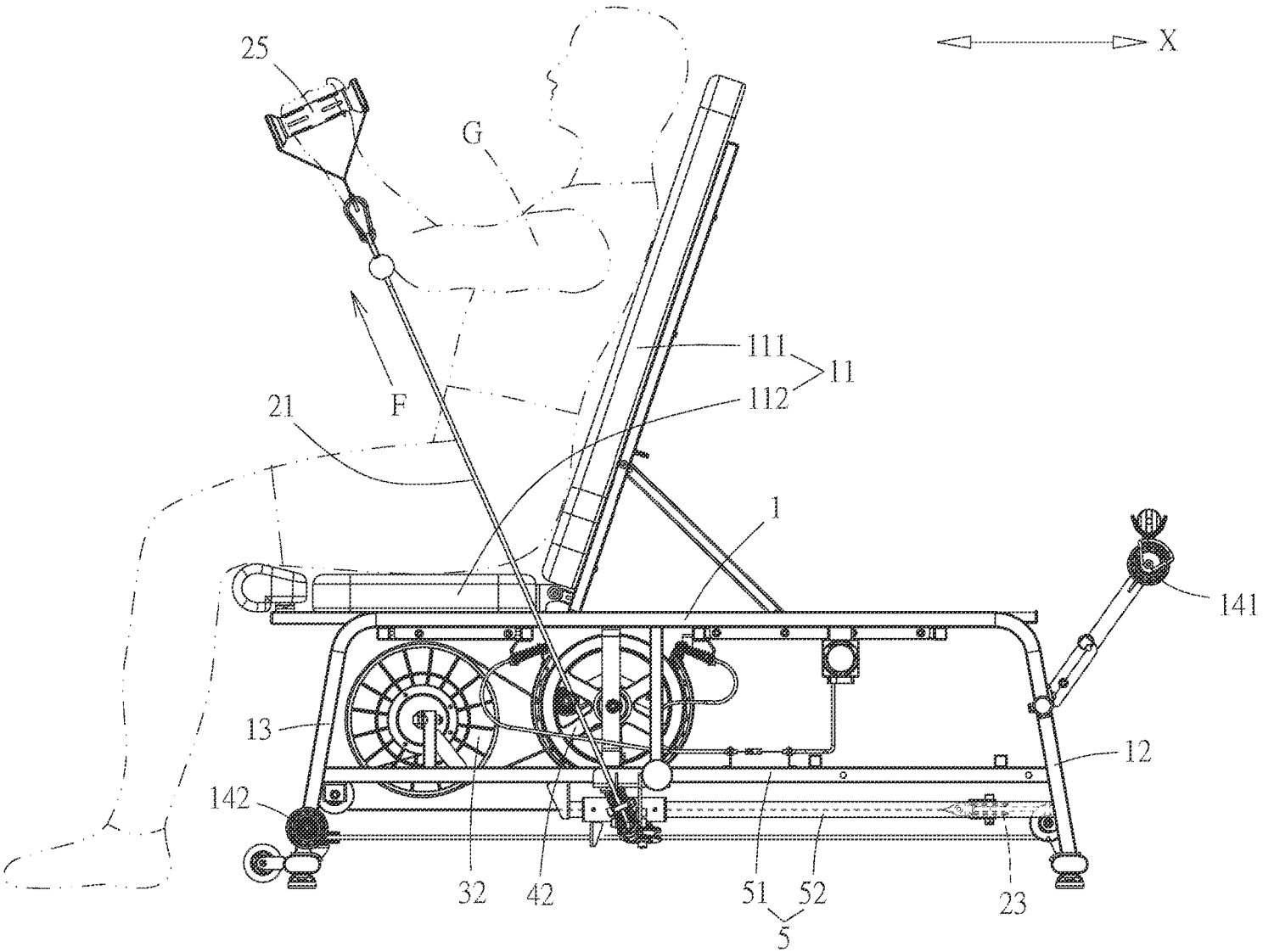
FIG. 15 shows a schematic view of the present embodiment used in a training mode where an operator sits and pulls in an inclined direction.

When the present invention is used in a training mode where the operator G sits and pulls in an inclined direction, as shown in FIG. 1, FIG. 9 and FIG. 15, first, the position of the movable seat 6 relative to the guiding piece 5 needs to be adjusted. The positioning member 63 is first taken out to escape from the positioning rod 51, and the positioning seat 62 is made to move toward the second side 13 from the first side 12 relative to the positioning rod 51. When the positioning seat 62 moves to the position of the positioning rod 51 close to the second side 13, the positioning member 63 is then positioned in the positioning hole 53 on the positioning rod 51, thereby allowing the movable seat 6 to be fixed on the guiding piece 5 again. The operator G sits on the second pad 112 of the recumbent portion 11, suspends both legs naturally on the second side 13 of the base frame 1, and then uses both hands to hold the handle 25 to apply force, pulling up the handle 25 in an inclined direction, in order to apply the operation force F to the two pull cords 21 to pull the two pull cords 21.

Referring to FIG. 2, FIG. 7, FIG. 8 and FIG. 11, next, by that the pull cord 21 links with the connecting piece 35, the one-way wheel 33 of the retracting unit 3 is driven to rotate in the first rotation direction R1, in order to drive the spindle 31 to rotate in the first rotation direction R1. By the one-way bearing 331, the spindle 31 can drive the transmission wheel 32 to rotate in the first rotation direction R1 and enable the volute spring 342 to accumulate a restoring force at a same time. By the resistance connecting piece 41, the transmission wheel 32 links with the resistor 42 to rotate, allowing the spindle 31 to be equipped with a rotation resistance. The rotation resistance is transmitted to the handle 25, thereby training the operator G who sits and pulls in an inclined direction. When the operator G no longer applies the force and puts down the handle 25, and the operation force F decreases or disappears, by the one-way bearing 331, the restoring force is used to drive the one-way wheel 33 to rotate idly on the spindle 31 in the second rotation direction R2, thereby retracting the connecting piece 35 to restore to its original location. By applying the force back and forth, it can achieve the function of training hands and chest.

Figure 16:
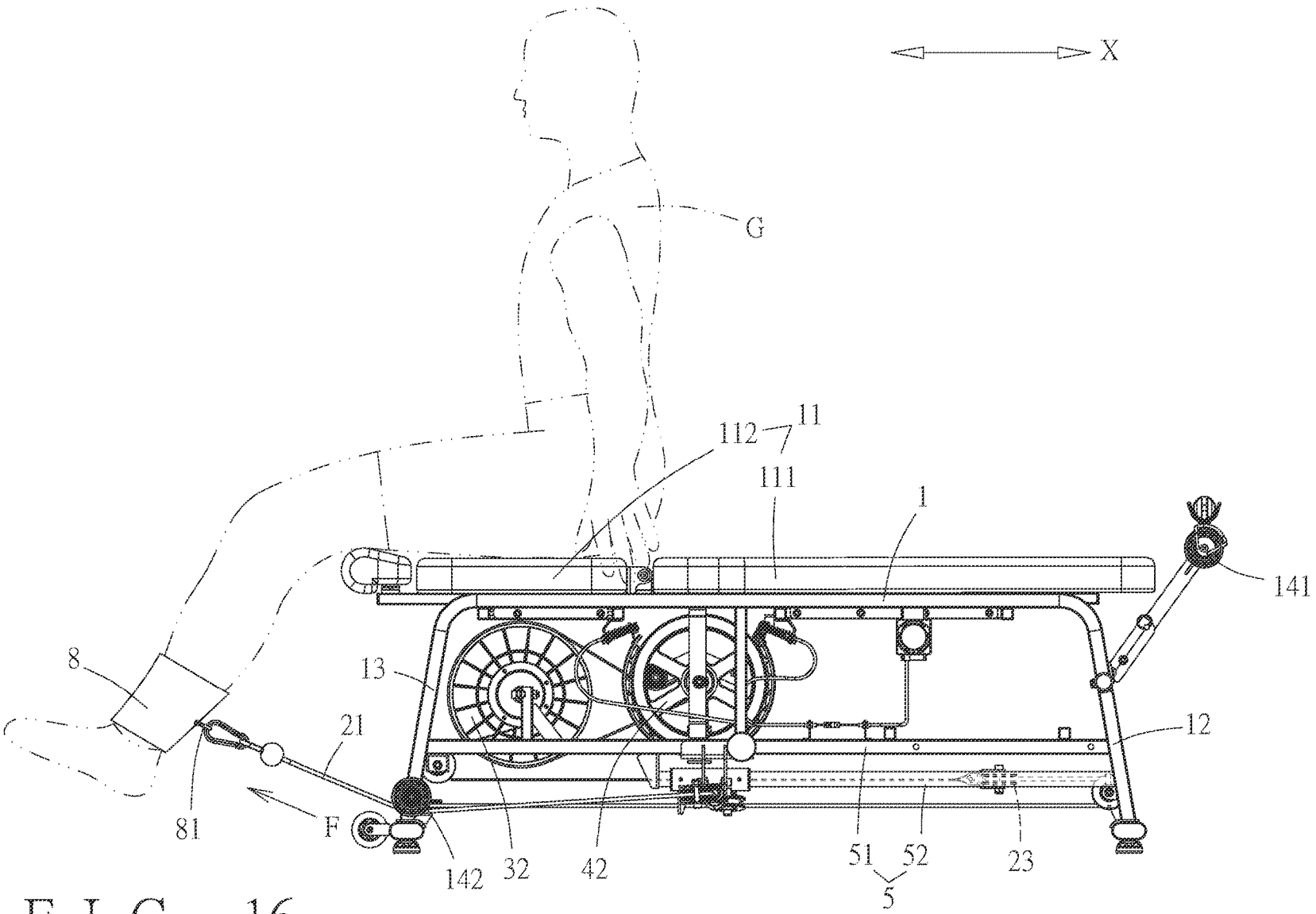
FIG. 16 shows a schematic view of the present embodiment used in a training mode for lifting legs.

When the present invention is used in a training mode for lifting legs, as shown in FIG. 1, FIG. 9 and FIG. 16, the free end 211 of the pull cord 21 wraps around the second side roller 142 selectively, allowing the pull cord 21 to move on the second side roller 142. Next, the wearing piece combination portion 81 of the wearing piece 8 is fixed on the free end 211 of the pull cord 21. The operator G sits on the second pad 112 of the recumbent portion 11, suspends both legs naturally on the second side 13 of the base frame 1, fastens the wearing pieces 8 on the legs, lifts the legs and applies force, in order to apply the operation force F to the wearing pieces 8 to pull the two pull cords 21.

Referring to FIG. 2, FIG. 7, FIG. 8 and FIG. 11, next, by that the pull cords 21 links with the connecting piece 35, the one-way wheel 33 of the retracting unit 3 is driven to rotate in the first rotation direction R1, in order to drive the spindle 31 to rotate in the first rotation direction R1. By the one-way bearing 331, the spindle 31 can drive the transmission wheel 32 to rotate in the first rotation direction R1 and enable the volute spring 342 to accumulate a restoring force at a same time. By the resistance connecting piece 41, the transmission wheel 32 links with the resistor 42 to rotate, allowing the spindle 31 to be equipped with a rotation resistance. The rotation resistance is transmitted to the wearing pieces 8, thereby training the operator G for lifting legs. When the operator G no longer applies force and removes the wearing pieces 8, and the operation force F decrease or disappears, by the one-way bearing 331, the restoring force is used to drive the one-way wheel 33 to rotate idly on the spindle 31 in the second rotation direction R2, thereby retracting the connecting piece 35 to restore to its original location. By applying the force back and forth, it can achieve the function of training legs and feet.

In the present invention, by changing the relative position between the movable seat 6 and the guiding piece 5, the position of the slide-assistance portion 61 on the base frame 1 can be changed, providing the operator G to apply force to the first side 12 or the second side 13 for training. Various kinds of training modes can be selected, and these training modes can be integrated together in one exercising device for use; therefore, the size can be reduced without taking space, and the operation modes can be diversified.

It is of course to be understood that the embodiments described herein is merely illustrative of the principles of the invention and that a wide variety of modifications thereto may be effected by persons skilled in the art without departing from the spirit and scope of the invention as set forth in the following claims.

What is claimed is:

1. A multifunctional recumbent exercising device, comprising:

a base frame, which is extended in a horizontal direction and is provided with a recumbent portion;

a first transmission unit, which is disposed on the base frame and includes a first pull cord, with the first pull cord being provided with a first free end and a first fixed end;

a first retracting unit, which is disposed on the base frame and is connected to the first transmission unit;

a resistance unit, which is disposed on the base frame;

a first guiding piece, which is disposed on the base frame; and a first movable seat, which selectively moves on or is fixed on the first guiding piece, with the first fixed end being fixed on the first movable seat, the first movable seat having a first slide-assistance portion, the first pull cord passing through the first slide-assistance portion, and the first free end being exposed out of the first slide-assistance portion;

wherein, by changing a relative position between the first movable seat and the first guiding piece, a corresponding position of the first slide-assistance portion on the base frame is changed.

2. The multifunctional recumbent exercising device according to claim 1, further comprising:

a second transmission unit, which is disposed on the base frame and includes a second pull cord, with the second pull cord having a second free end and a second fixed end;

a second retracting unit, which is disposed on the base frame and is connected to the second transmission unit;

a second guiding piece, which is disposed on the base frame; and a second movable seat, which selectively moves on or is fixed on the second guiding piece, with the second fixed end being fixed on the second movable seat, the second movable seat including a second slide-assistance portion, the second pull cord passing through the second slide-assistance portion, and the second free end being exposed out of the second slide-assistance portion;

wherein, by changing a relative position between the second movable seat and the second guiding piece, a corresponding position of the second slide-assistance portion on the base frame is changed.

3. The multifunctional recumbent exercising device according to claim 2, wherein the second guiding piece is extended in a horizontal direction and includes a second positioning rod and a second slide rail, the second movable seat is provided with a second positioning seat corresponding to the second positioning rod, the second positioning seat is provided with a second positioning member, the second positioning member is selectively positioned on the second positioning rod, the second movable seat is provided with a second slide seat corresponding to the second slide rail, and the second slide seat holds the second slide rail, whereas when the second positioning member is no longer positioned on the second positioning rod, the second movable seat slides on the second guiding piece by the second slide seat.

4. The multifunctional recumbent exercising device according to claim 3, wherein the second positioning rod is axially provided with plural second positioning holes, the second positioning member is a second positioning pin, and the second positioning pin is inserted into or removed from a second positioning hole of the plural second positioning holes.

5. The multifunctional recumbent exercising device according to claim 2, wherein the second slide-assistance portion is a second perforation or a second slide-assistance roller.

6. The multifunctional recumbent exercising device according to claim 5, wherein the second slide-assistance roller is pivoted on a second slide-assistance roller seat, and the second slide-assistance roller seat is rotatably fixed on the second movable seat.

7. The multifunctional recumbent exercising device according to claim 2, wherein the second transmission unit includes a second pulley set, the second pulley set further includes a second moving pulley and a second fixed pulley, the second pull cord wraps around the second moving pulley and the second fixed pulley, the second retracting unit includes a second retractor and a second connecting piece, and the second connecting piece is connected to the second retractor and the second moving pulley.

8. The multifunctional recumbent exercising device according to claim 2, wherein the recumbent portion is extended in a horizontal direction and includes a first pad and a second pad, the first pad is provided with a first surface, the second pad is provided with a second surface, an included angle is disposed between the first surface and the second surface, and the included angle is between 0° and 180°.

9. The multifunctional recumbent exercising device according to claim 2, wherein the second movable seat includes a second movable seat roller, the second pull cord wraps around the second movable seat roller and passes through the second slide-assistance portion.

10. The multifunctional recumbent exercising device according to claim 2, wherein the base frame is provided with a first side and an opposite second side in a horizontal direction, the first side is provided with a bracket, the bracket is provided with a first side roller, and the second free end selectively passes through the first side roller and is fixed on a handle, allowing the second pull cord to move on the first side roller.

11. The multifunctional recumbent exercising device according to claim 2, wherein the base frame is provided with a first side and an opposite second side in a horizontal direction, the second side is provided with a second side roller, and the second free end selectively passes through the second side roller and is fixed on a handle, allowing the second pull cord to move on the second side roller.

12. The multifunctional recumbent exercising device according to claim 2, further comprising a pull rod, wherein the pull rod is provided with a pull rod combination portion, and the second free end is selectively fixed on the pull rod combination portion.

13. The multifunctional recumbent exercising device according to claim 2, further comprising a wearing piece, wherein the wearing piece is provided with a wearing piece combination portion, and the second free end is selectively fixed on the wearing piece combination portion.

14. The multifunctional recumbent exercising device according to claim 1, wherein the first guiding piece is extended in a horizontal direction and includes a first positioning rod and a first slide rail, the first movable seat is provided with a first positioning seat corresponding to the first positioning rod, the first positioning seat is provided with a first positioning member, the first positioning member is selectively positioned on the first positioning rod, the first movable seat is provided with a first slide seat corresponding to the first slide rail, and the first slide seat holds the first slide rail, whereas when the first positioning member is no longer positioned on the first positioning rod, the first movable seat slides on the first guiding piece by the first slide seat.

15. The multifunctional recumbent exercising device according to claim 14, wherein the first positioning rod is provided axially with plural first positioning holes, the first positioning member is a first positioning pin, the first positioning pin corresponds to a first positioning hole of the plural first positioning holes and is inserted into or removed from the first positioning hole.

16. The multifunctional recumbent exercising device according to claim 1, wherein the first slide-assistance portion is a first perforation or a first slide-assistance roller.

17. The multifunctional recumbent exercising device according to claim 16, wherein the first slide-assistance roller is pivoted on a first slide-assistance roller seat, and the first slide-assistance roller seat is rotatably fixed on the first movable seat.

18. The multifunctional recumbent exercising device according to claim 1, wherein the first transmission unit includes a first pulley set, the first pulley set further includes a first moving pulley and a first fixed pulley, the first pull cord wraps around the first moving pulley and the first fixed pulley, the first retracting unit includes a first retractor and a first connecting piece, and the first connecting piece is connected to the first retractor and the first moving pulley.

19. The multifunctional recumbent exercising device according to claim 1, wherein the recumbent portion is extended in a horizontal direction and includes a first pad and a second pad, the first pad is provided with a first surface, the second pad is provided with a second surface, an included angle is disposed between the first surface and the second surface, and the included angle is between 0° and 180°.

20. The multifunctional recumbent exercising device according to claim 1, wherein the first movable seat includes a first movable seat roller, the first pull cord wraps around the first movable seat roller and passes through the first slide-assistance portion.

21. The multifunctional recumbent exercising device according to claim 1, wherein the base frame is provided with a first side and an opposite second side in a horizontal direction, the first side is provided with a bracket, the bracket is provided with a first side roller, and the first free end selectively passes through the first side roller and is fixed on a handle, allowing the first pull cord to move on the first side roller.

22. The multifunctional recumbent exercising device according to claim 1, wherein the base frame is provided with a first side and an opposite second side in a horizontal direction, the second side is provided with a second side roller, and the first free end selectively passes through the second side roller and is fixed on a handle, allowing the first pull cord to move on the second side roller.

23. The multifunctional recumbent exercising device according to claim 1, further comprising a pull rod, wherein the pull rod is provided with a pull rod combination portion, and the first free end is selectively fixed on the pull rod combination portion.

24. The multifunctional recumbent exercising device according to claim 1, further comprising a wearing piece, wherein the wearing piece is provided with a wearing piece combination portion, and the first free end is selectively fixed on the wearing piece combination portion.

* * * * *